US005152200A

United States Patent [19]

Kaplan

[11] Patent Number: 5,152,200

[45] Date of Patent: Oct. 6, 1992

[54] TORQUE SIGNALLING WRENCH

[75] Inventor: Steve E. Kaplan, Elyria, Ohio

[73] Assignee: Multilink, Inc., Elyria, Ohio

[21] Appl. No.: 657,133

[22] Filed: Feb. 19, 1991

[51] Int. Cl.[5] ..... B25B 23/142

[52] U.S. Cl. ..... 81/478; 81/483; 81/467

[58] Field of Search ..... 81/478, 483, 467

[56] References Cited

U.S. PATENT DOCUMENTS 2,934,985 5/1960 Mutolo et al. ..... 81/483
3,018,677 1/1962 Mutolo et al. ..... 81/483

FOREIGN PATENT DOCUMENTS 2222387 2/1973 Fed. Rep. of Germany ..... 81/483

*Primary Examiner*—Bruce M. Kisliuk
*Assistant Examiner*—Lawrence Cruz
*Attorney, Agent, or Firm*—J. Herman Young, Jr.

[57] ABSTRACT

A simplified torque signalling wrench in which the torque responsive means comprises a camming recess or notch in the outer end of a wrench shank within a handle for the wrench and to which the shank is pivoted to provide limited angular movement for the outermost end of the shank with a ball surface being yieldingly forced into the recess defined by walls of the recess by spring loading to maintain the shank along the centerline of the handle and yielding to camming forces under a torque load to effect relative angular movement of the shank and handle to signal a torque load in excess of a torque load determined by the adjustable loading of the spring.

12 Claims, 1 Drawing Sheet

TORQUE SIGNALLING WRENCH

BACKGROUND OF THE INVENTION

The present invention relates to a torque signalling wrench, and, more particularly, to a simplified structure for such a wrench enabling low cost production of the wrench including cost of manufacturing parts and assembly.

Torque limiting wrenches are known. The known wrenches have a wrench shank structure associated with a handle for the wrench and a torque responsive unit comprising a swivel type connection is also associated with the handle and provides for relative movement between elements of the torque responsive unit for limiting the torque applied by the wrench. In the known wrenches, the torque responsive unit is a unit which is fabricated separately and incorporated into the handle for the wrench. These units complicate the manufacture of torque wrenches because of the nature of the parts and the assembly operations required, thereby, increasing the cost of such wrenches.

It is an object of the present invention to provide a torque wrench which signals when the applied torque exceeds an adjustable threshold and in which requires a minimum of simple parts which are such that prefabricated torque responsive units are not necessary, the fabrication the parts only requiring simple machine or forming operation with the assembly of the torque signalling wrench being a simple assembly operation and the design enabling standard production wrench heads with handle shanks to be utilized.

SUMMARY OF INVENTION

In accordance with the preferred design of the invention, a wrenching head, which may be a conventional flat type open-end wrench head, having a shank, preferably a relatively flat shank, extending outwardly from the wrenching head into a tubular handle member with the shank terminating in an outer end disposed within the handle member toward the outer end of the handle member. The shank is pivoted to the handle member near the inner end of the handle to provide limited relative angular movement of the shank and handle member about a pivot, preferably relative movement to either side of a centered position along the centerline of the handle member. The maximum crosswise dimension of the shank is somewhat smaller than the internal diameter of the handle to permit the relative angular movement with the movement being limited by the engagement of the outer end of the shank and the internal wall of the handle member. Preferably the shank is normally held along the center line of the handle by torque responsive means which will yield to allow relative angular movement between the shank and the handle when a predetermined wrenching threshold is reached. In the preferred embodiment, the torque responsive means includes a movable ball element having a surface of which a portion thereof is received in a recess in the outer end of the shank between opposed walls defining the recess. The outer end portions of the opposed walls engage the ball surface on opposite sides of the handle centerline equidistant therefrom. A moveable centering member supports the ball element on the centerline of the handle member is axially moveable along the centerline. A spring disposed within the outer end portion of the handle urges the centering member and the ball element inwardly toward the outer end of the shank to yieldingly force the ball surface into the notch or recess in the shank end to center the shank on the centerline of the handle and to hold it centered unless sufficient torque force is applied to effect a camming of the ball away from the shank end by the walls of the engaging the ball surface. The outer end of the spring abuts an adjustable spring stop member which is adjustable axially of the handle member to adjust the biasing force of the spring to determine the torque threshold for the wrench. When the torque threshold is reached, the applied torque forces on the handle cause the walls defining the recess or notch to cam the ball outwardly of the handle and to allow relative movement between the handle member and the shank to signal that the torque threshold has been reached. In the preferred and illustrated embodiment, the construction is such that the assembly operation for the wrench is simple. After inserting a pin to pivotally mount the shank inside the handle and preferably filler plates which are loosely associated with the shank to laterally position the shank on the centerline of the handle, the ball, the ball centering member for the ball and the spring can merely be dropped into the handle and the adjustable spring stop member moved into engagement with the outer spring end, preferably by threading.

DESCRIPTION OF THE DRAWINGS

Referring to the drawings which illustrate a preferred embodiment hereof and which are part of the present specification for all subject matter disclosed therein, and in which.

DESCRIPTION OF THE INVENTION

Figures 1, 2, 3, 4, 5:
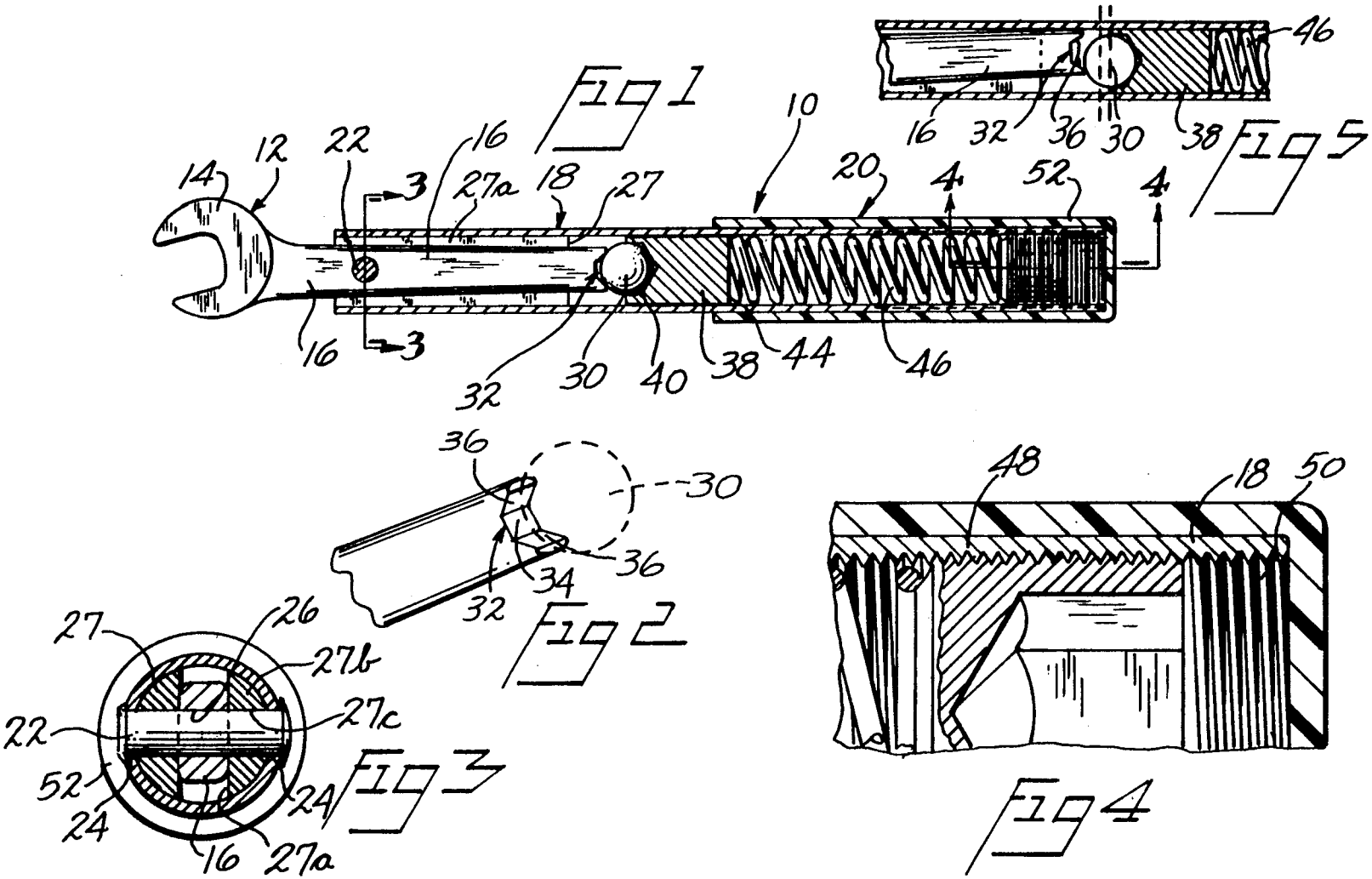
FIG. 1 is a longitudinal cross-sectional view of a wrench embodying the present invention.
FIG. 2 is a fragmentary perspective view of a portion of the wrench of FIG. 1 showing the outer end of the shank and the cooperating ball element.
FIG. 3 is a cross-sectional view of the wrench of FIG. 1 taken as indicated by the line 3—3 of FIG. 1.
FIG. 4 is an enlarged fragmentary sectional view of the right hand end portion of the wrench of FIG. 1 showing the spring adjustment stop member and an end portion of the spring within the handle of the wrench.
FIG. 5 is fragmentary showing of FIG. 1 illustrating the wrench shank and handle of FIG. 1 when in a torque signalling position.

FIG. 1 illustrates a torque signalling wrench 10 embodying the preferred embodiment of the present invention. The torque signalling wrench 10 includes as the wrenching member a conventional flat type open-ended wrench 12 having a flat type wrenching head 14 and a generally flat shank 16 which extends outwardly from the wrenching head 14 into a tubular handle member 18 of the handle 20 of the torque signalling wrench 10. The maximum crosswise dimensions of the shank 6 are somewhat smaller than the inside diameter of the tubular member 18 to allow the wrench to be supported for limited angular movement within the handle by a pivot pin 22. The pivot pin 22 is mounted in diametrically opposed openings 24 in the side wall of the tubular member 18 and extends through an aligned crosswise opening 26 in the wrench shank 16, and through aligned openings in filler flats 27, one on either side of the shank 16. The filler plates 27 are chordal segments of a cylinder to provide a flat side **27*a* which lies along the adjacent side of the shank and a cylindrically curved side 27b which corresponds to the internal curvature of the tubular handle member 18. The openings in the filler plates are located so that when the openings are aligned with the openings 24, the filler plates extend to and terminate at the inner end of the tubular member. This simplifies locating the filler plates in the handle during assembly. The pivot pin axis is perpendicular to the plane of wrenching movement of the wrench, as well as perpendicular to the center line of the length of the shank 16. The pivot pin and filler plates allow the wrench to have limited angular movement about the pivot pin inside the tubular handle. The shank 16 extending from the pivot pin is maintained along the center line of the tubular member 18 by means comprising a spherically shaped element, preferably a ball 30, of somewhat smaller diameter than the inside of the tubular member 18. The ball 30 is of a size such that a portion of its surface (less that 180 degrees) is received in a notch, or recess, 32 formed in the outer end of the shank to effect a centering of the shank along the centerline of the handle. The notch or recess 32 has a bottom surface 34 which extends essentially crosswise of the shank and side walls 36** extending axially outwardly from the bottom at an angle of approximately 45 degrees to form a space for receiving a portion of the surface of the ball between the walls with the walls engaging the ball on opposite sides of the center line substantially equidistantly from the center line when the shank is lying along the center line of the handle. The walls defining the recess or notch are centered on the plane of wrenching movement of the handle extending through the centerline of the handle.

The ball element 30 is maintained in a centered position inside the tubular handle 18 by a spring stop, or centering member 38 disposed inside the tubular handle member on the side of the ball remote from the end of the shank 16. The centering member 38 has a circular recessed surface 40 with a conically shaped bottom for receiving and holding the ball in a centered position with the ball element in engagement with the outer end of the shank 16. The rear side 44 of the centering member, which extends transversely of the tubular member 18, is engaged by the inner end of a biasing spring 46 for yieldably urging the centering member and in turn the ball against the outer end of the shank 16. Both the centering member 38 and the spring are axially moveable in the handle 18.

The outer end of the spring 46 engages an adjustable spring stop member 48 which, in the preferred embodiment, is shown as a set screw which threads into outer end of the tubular handle member 18. The outer end of the tubular handle member 18 is provided with internal threads 50 for this purpose. The end of the tubular member 18 is closed by the end of a plastic sheath 52 which fits over the outer end of the tubular member 18 and extends to approximately the center of the tubular member to provide a hand grip for wrenching. The plastic sheath has a close fit but is removable.

From the foregoing description, it can be seen that the biasing spring 46 will urge the ball element into the notch in the end of shank 16 to relatively center the shank and tubular handle member on the center line of the handle. When the wrench is used and torquing forces are applied to the handle, the forces will tend to move the ball laterally relatively to the shank in the direction of wrenching movement and cause reaction forces in the end portion of the notch wall which is disposed in the direction which the ball is being forced. When sufficient force is applied, the ball element will be cammed or cam itself along its spherical surface to move the ball axially in the handle in response the reaction forces in the shank, which is being held by the torque resistance of the element being wrenched. This causes the handle and shank to relatively move angularly until the end of the shank engages the internal side wall of the handle member as is shown in FIG. 5. It is to be understood that the angular movement is insufficient to allow both end walls to move to one side of the center line so as to prevent an over center lock-up condition which would prevent the return of the shank to a centered position when the torque force is relaxed or released.

It can be seen that the wrench is of simple construction requiring no prefabricated units such as a swivel unit to be mounted on the end of the wrench shank, the elements of the wrench being simple and readily available or simply manufactured with only simple machine operations.

The assembly of the wrench is simple, the filler plates along with wrench shank can be simply be inserted into the tubular handle at its inner end and the pin 22, which may be a conventional rivet pin, inserted to hold the parts in position. The ball then may be dropped into the outer end of the tubular handle followed by the ball centering member 38, in turn, followed by the spring 46 with the set screw 50 then being threaded into the opening to engage the end of the spring and to adjust it to set the proper compression in the spring. The plastic sheath then can be applied to close the open outer end of the handle and provide a hand grip on the tubular handle member 18.

In a preferred embodiment, the wrenching head and shank is a typical open-ended wrench head with a relatively flat shank with the flat shank provided with the notch 32 which formed with the head and shank or proved by a simple machining operation. The ball centering mechanism is a simple cylindrical block with only a simple recess formed in one end to receive and trap the ball.

In summary, when the wrenching head is used to wrench a part, such as the head of a bolt or nut, about an axis, the biasing spring will maintain an alignment of the shank along the center line of the tubular handle until a predetermined torque is reached. As this torque is exceeded, the reaction forces on the side walls of the notch will tend to move the ball axially against the biasing spring. Upon reaching the torque threshold setting of the spring, the ball element is cammed axially sufficiently to allow the tubular handle to move angularly relative to the shank of the wrench, the angular movement of the shank itself being resisted by the part being wrenched. It is noted that the internal dimension of the tubular handle is such relative to the notch in the end of the shank that the end walls of the notch in the shank in engagement with the ball cannot move over center so that the handle will return to a straight position when the torquing force is released.

It is the movement of the handle relative to the shank that signals that the desired torque threshold has been reached. However, it will further be noted that continued wrenching of the element can occur when the outer end of the wrench engages the internal side wall of the tubular wrench member 18. It is also clear that torque signalling will occur in either direction of movement of the wrench handle.

From the foregoing description, it will be obvious to those in the art that modifications can be made in the preferred embodiment to accomplish the objects of the preferred embodiment, i.e. simple parts, a reduced number of parts, and easy assembly, for example, it may be convenient for a manufacturer to form the ball 30 and its centering member 38 as one piece which may be cammed axially. Also, the wrench head may comprise a socket extending perpendicular from the head instead of the open ended wrenching slot.

Having described my invention, I claim:

1. A torque wrench having a wrenching head and a shank extending outwardly of said wrenching head for turning said wrenching head about an axis, a tubular handle having an open inner end receiving said shank with the shank terminating in an outer end disposed in said handle, connecting means displaced inwardly of the inner end of said handle for connecting said handle to said shank and mounting said handle and said shank for limited movement about a pivot which has its axis perpendicular to the plane of wrenching movement of the wrenching head, torque responsive means in said handle for positioning said handle about the pivot with the shank of the wrench head lying along the axis of said handle and for effecting relative movement of said handle and shank about said pivot in response to a torque threshold comprising means providing a ball surface in engagement with the outer end of said shank for centering said shank on said axis and movably supported in the tubular member for movement along said center line, and a spring in said handle outwardly of said centering means for urging said ball surface into engagement with the outer end of said shank, the outer end of said shank having a recess for receiving said ball surface for constraining said shank to lie along said center line while transmitting torquing forces between said handle and said shank and for caming said ball surface outwardly along said center line against the urging of said spring in response to the torque load on said handle to effect relative angular movement of said shank and handle about said pivot axis in response to the torque load on said wrenching head, and an adjustable spring abutment member in said handle engaging the outer end of said spring for adjusting the spring force urging said centering means against the outer end of said shank to adjust the response of said torque responsive means to the torque load on said handle and shank, said shank having a generally flat configuration and filler plates disposed along said shank adjacent either side of the inner end of said handle, said filler plates having openings and a pivot pin passing through said openings in said filler plates and said shank for pivotally mounting said shank in said handle for movement about said axis.

2. A torque wrench as defined in claim 1 in which said centering means comprises a ball and a member formed with a recess for receiving said ball and maintaining it in engagement with the outer end of said shank and in a centered position on the centerline of said handle.

3. A torque wrench as defined in claim 1 wherein said handle comprises an open-ended tubular member receiving said shank and said spring adjusting member, said spring adjusting member comprising a member threaded into the outer end of said tubular handle member.

4. A torque wrench as defined in claim 2 wherein said handle comprises an open-ended tubular member receiving said shank and said spring adjusting member, said spring adjusting member comprising a member threaded into the outer end of said tubular handle member.

5. A torque wrench having a wrenching head and a shank extending outwardly of said wrenching head for turning said wrenching head about an axis, a tubular handle having a center line which lies along the plane of wrenching movement of the handle and an open inner end receiving said shank with the shank terminating in an outer end disposed in said handle, connecting means displaced inwardly of the inner end of said handle for connecting said handle to said shank and mounting said handle and said shank for limited movement about a pivot which has its axis perpendicular to the plane of wrenching movement of the handle, torque responsive means in said handle for positioning said handle about the pivot with the centerline of the shank lying along the center line of said handle in the absence of a torque load and for effecting relative angular movement of said handle and shank about said pivot axis in opposite directions from the center line in response to torque exceeding a threshold comprising means providing a ball surface having its center on the center line of the handle and engaging the outer end of said shank for centering said shank on said handle center line and movably supported in the tubular member for movement along said handle center line, and a spring in said handle outwardly of said centering means for urging said ball surface into engagement with the outer end of said shank, the outer end of said shank having a recess for receiving said ball surface for constraining said shank to lie along said handle center line while transmitting torquing forces between said handle and said shank and for camming said ball surface outwardly along said handle center line against the urging of said spring in response to the torque load on said handle exceeding said threshold to effect relative angular movement of said shank and handle in one direction or the other about said pivot depending on the direction of torquing to signal a torque exceeding said threshold.

6. A torque wrench as defined in claim 5 in which said centering means comprises a ball and a member formed with a recess for receiving said ball and maintaining it in a centered position on the center line of said handle while in engagement with the outer end of said shank while transmitting torque below said threshold.

7. A torque wrench as defined in claim 5 in which said recess comprises a notch having walls symmetrical to either side of the center line of the shank for engaging said ball surface substantially symmetrically with respect to the centerline of the handle when the centerlines of the handle and shank are aligned.

8. A torque wrench as defined in claim 6 in which said recess comprises a notch having walls symmetrically located to either side of the center line of the shank for engaging said ball substantially equidistantly with respect to the centerline of the handle with centerline of the shank laying along the center line of the handle.

9. A torque wrench as defined in claim 5 wherein said shank has a generally flat configuration and filler plates are disposed along said shank adjacent either side of the inner end of said handle, said filler plates having openings passing a pivot pin for pivotally mounting said shank in said handle.

10. A torque wrench as defined in claim 6 wherein said shank has a generally flat configuration and filler plates are disposed along said shank adjacent either side of the inner end of said handle, said filler plates having openings passing a pivot pin for pivotally mounting said shank in said handle.

11. A torque wrench as defined in claim 7 wherein said shank has a generally flat configuration and filler plates are disposed along said shank adjacent either side of the inner end of said handle, said filler plates having openings passing a pivot pin for pivotally mounting said shank in said handle.

12. A torque wrench as defined in claim 8 wherein said shank has a generally flat configuration and filler plates are disposed along said shank adjacent either side of the inner end of said handle, said filler plates having openings passing a pivot pin for pivotally mounting said shank in said handle.

* * * * *